United States Patent [19]

Turner

[11] 4,087,947

[45] May 9, 1978

[54] EDGE-LIFTING SYSTEM FOR A CONCRETE SLAB

[75] Inventor: Norman G. Turner, Poway, Calif.

[73] Assignee: Superior Concrete Accessories, Inc., San Diego, Calif.

[21] Appl. No.: 723,518

[22] Filed: Sep. 15, 1976

[51] Int. Cl.[2] ..... B25B 29/00

[52] U.S. Cl. ..... 52/125; 52/686; 52/699; 294/90

[58] Field of Search ..... 404/47, 52, 45, 70, 404/135, 134, 136; 52/125, 583, 587, 686, 712, 704, 665, 699; 248/302, 303, 249, 215; 294/89, 93, 94, 96, 90

[56] References Cited

U.S. PATENT DOCUMENTS

| | | | |
|---|---|---|---|
| 1,975,235 | 10/1934 | Lowell | 52/125 |
| 2,102,566 | 12/1937 | Brickman | 404/134 |
| 2,642,966 | 6/1953 | Sylvan | 52/665 |
| 2,772,560 | 12/1956 | Neptune | 52/704 |
| 2,920,475 | 1/1960 | Graham | 52/587 |
| 3,049,204 | 8/1962 | Sorenson | 52/496 |
| 3,356,399 | 12/1967 | Young | 52/712 |
| 3,400,506 | 9/1968 | Thompson | 52/498 |
| 3,499,676 | 3/1970 | Haeussler | 294/90 |
| 3,505,768 | 4/1970 | Bentley | 52/704 |
| 3,596,418 | 8/1971 | Sedwick | 52/125 |
| 3,600,863 | 8/1971 | Nachsheim | 52/583 |
| 3,785,110 | 1/1974 | Galloway | 52/665 |

FOREIGN PATENT DOCUMENTS

| | | | |
|---|---|---|---|
| 269,478 | 1/1914 | Germany | 52/686 |

*Primary Examiner*—John E. Murtagh
*Attorney, Agent, or Firm*—Norman H. Gerlach

[57] ABSTRACT

A system for the edge-lifting of a horizontally disposed concrete slab either for transport or tilt-up operations, and embodying components which, after positioning in the slab form, become embedded in the slab after the wet concrete is poured and has become set or hardened. Such components include a horizontal reinforcing bar which extends through the edge region of the slab at a low level and imparts reaction force to a slab-lifting anchor bolt thereabove through the medium of a hanger clip at the time that the slab is lifted. The anchor bolt is fixedly positioned in the slab form and the hanger clip is hung on the anchor bolt and serves to support the reinforcing rod therebeneath in cradle-like fashion preparatory to a concrete-pouring operation for slab-forming purposes. The hanger clip of the system obviates the necessity of creating an upward offset in the reinforcing rod and hanging the rod directly on the anchor bolt at the point of the offset.

2 Claims, 6 Drawing Figures

EDGE-LIFTING SYSTEM FOR A CONCRETE SLAB

The present invention relates to a system for the edge-lifting of a concrete slab, as, for example, in the performance of tilt-up operations of the type where a wall slab is formed by pouring wet concrete into a concrete slab form at floor level and then, after the concrete has set or hardened, tilting the horizontal slab on one edge region by lifting the opposite edge region until the slab becomes vertical so that it may be pushed into position where it serves as a wall of a concrete-type building undergoing construction. The invention is, however, not limited to slab tilt-up operations and, if desired, the system may be employed without modification in the lifting of a slab for transport purposes in order to install the slab at a region remote from that where the slab was formed by pouring wet concrete into the slab form.

Heretofore, in the production of a wide variety of concrete slabs which are to be handled by edge-lifting operations, it has been the practice to support an anchor bolt in a horizontal position within a slab form in such a manner that after the concrete has been poured and becomes set or hardened, an end of the bolt remains exposed and accessible for edge-lifting of the slab. Where a relatively thin slab is concerned, the partially embedded horizontal anchor bolt is unable to distribute the involved shear stress when lifting operations commence with the result that localized stresses which are imparted to the edge region of the slab are beyond the ability of the concrete to resist them so that frequently the slab fractures with resultant release of the anchor bolt. In an effort to obviate this difficulty, it also has been the practice horizontally to position the anchor bolt at approximately a mid-level in the slab and to traverse the bolt with a reinforcing rod which extends at right angles to and rests upon the anchor bolt in the slab form so that when the concrete is poured and the slab created, the reinforcing rod, to a certain extent, serves to distribute the shear forces that are applied by the anchor bolt. Even when this expedient is resorted to occasional slab rupture or fracture takes place since the reinforcing rod lies fairly close to the upper surface of the slab. In an effort to overcome the difficulty which this latter expedient presents, it has been proposed to place the reinforcing rod relatively low in the slab form and beneath the anchor bolt and, in order to support it in position, an upward offset in the form of a medial inverted V-bend is created in the reinforcing rod, this V-bend arching over the anchor bolt in saddle-like fashion and resting upon the bolt. Then, when the concrete is poured and has hardened, the reinforcing rod imparts reaction force to the anchor bolt when the latter is raised vertically, such reaction force being exerted upon the anchor bolt through the medium of the saddle-like offset.

The latter system has proved quite satisfactory in use, but it does possess a form-erecting disadvantage in that contractors frequently disregard the manufacturer's instructions regarding creating the V-bend in the reinforcing rod and, regardless of such instructions, place the reinforcing rod at approximately the same level as the anchor bolt by supporting the linearly straight reinforcing rod directly on the anchor bolt in the concrete slab form, thus creating the condition previously outlined above.

The present invention is designed to overcome this operational disadvantage that is attendant upon the formation of a concrete slab that is to be edge-lifted for either transport or tilt-up operations and, toward this end, the invention contemplates the provision of a system which embodies a novel hanger clip whereby the reinforcing rod may be conveniently suspended at a low level in the concrete slab form and allowed to remain linearly straight so that it passes beneath the anchor bolt in a direction normal to that of the bolt. Thus, when the concrete is poured into the form and thereafter becomes hardened in order to produce the slab, the hanger clip transmits to the reinforcing rod the lifting force which is applied to the anchor bolt during edge-lifting of the latter. By such an arrangement, the contractor is not obliged to bend the reinforcing rod and he attains the desired low level placement of the reinforcing rod in the completed slab.

Ease of suspension of the reinforcing rod from the anchor bolt in the slab form is attained by the provision of a saddle-like support for the hanger clip on the anchor bolt, and the provision of a cradle-like support for the reinforcing rod on the hanger clip.

The provision of a hanger clip which is for the particular purpose set forth above, is extremely simple in its construction and consists as it does of a length of stiff wire stock which is bent to shape, consequently, is not costly to produce; one which may be constructed in quantity with conventional rod or wire-working machinery; and one which may readily be properly applied to the associated anchor bolt and reinforcing rod within the concrete slab form without entailing the use of skilled labor, are further desirable features which have been borne in mind in the development of the present edge-lifting system.

The provision of an edge-lifting system such as has briefly been outlined above and possessing the stated advantages, constitutes the principal object of the present invention.

Numerous other objects and advantages of the invention not at this time enumerated will become readily apparent as the following description ensues.

The invention consists in the several novel features which are hereinafter set forth and are more particularly defined by the claims at the conclusion hereof.

In the accompanying single sheet of drawings forming a part of this specification, one illustrative embodiment of the invention is shown.

Figure 1:
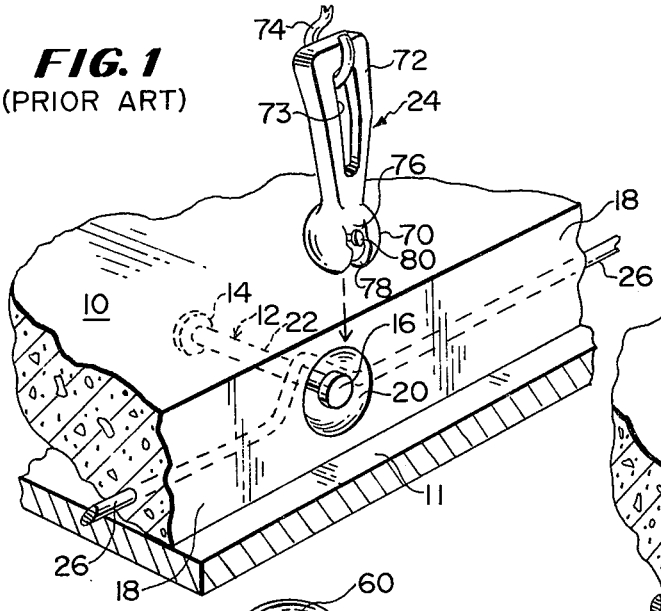
FIG. 1 (PRIOR ART)
FIG. 1 is a fragmentary perspective view of an edge region of a concrete slab which is to be lifted for slab-tilting purposes, such view illustrating a prior art lifting system over which the present system is purported to be an improvement.

Referring now to the drawings in detail and in particular to FIG. 1, there is disclosed in this view a horizontally positioned, comparatively thin concrete slab 10 which, for purposes of discussion herein, may be regarded as a wall slab which has been formed by pouring wet concrete into a form and is adapted, after hardening of the concrete, to have one edge region thereof lifted from the form base 11 to effect a tilt-up operation to a vertical position where it constitutes a wall in a building installation. It is, of course, to be understood that the particular edge-lifting system constituting the present invention may be a concrete girder, beam, or other structure which is to be lifted for transport hoisting at a remote location, instead of the illustrated concrete wall slab 10.

Heretofore, and as shown in the prior art view constituting FIG. 1 of the drawings, when an edge portion of a relatively comparatively thin wall or other concrete slab which has been cast horizontally is to be tilted to a vertical position, it has been customary to utilize a system of the general type which is disclosed in U.S. Pat. No. 3,499,676, granted on Mar. 10, 1970, and entitled "SYSTEM FOR MANIPULATING CONCRETE BODIES." Although such patent describes the system in connection with the placement of an anchor bolt vertically in the medial region of a concrete slab, the same system is frequently used by placing the anchor bolt horizontally in a slab and allowing the lifting end of such bolt to become exposed or available at one edge of the slab for lifting or tilt-up purposes.

The lifting system of aforementioned U.S. Pat. No. 3,499,676, when used for edge-lifting of a slab, entails the placement of an anchor bolt, such as the bolt 12 of FIG. 1, in a concrete form so that the bolt extends horizontally in the slab edge region which is to be lifted and at such an elevation that when the concrete is poured into the form, the bolt lies substantially midway between the top and bottom surfaces of the concrete slab which is ultimately to be cast. An enlarged foot 14 on the inner end of the anchor bolt 12 resists longitudinal pulling of the bolt from the surrounding concrete and an enlarged head 16 on the outer end of the bolt is exposed on the edge proper 18 of the slab 10 and is disposed within the confines of a semi-cylindrical recess 20 which is left in the concrete when a rubber or other pattern member which is adhered to the adjacent vertical side of the form wall is removed with the form wall after the concrete has become set. This enlarged head and the exposed adjacent portion of the bolt shank 22 are designed for cooperation with a special form of coupling body or lifting eye 24 which hooks over the exposed bolt shank for hoisting purposes. A transverse reinforcing rod 26 extends along the slab edge region which is to be lifted at a fairly low level of the form and at the region where such rod approaches the anchor bolt 12, this rod is bent upwardly and extends over the anchor bolt so that the rod may be hung or supported from the latter prior to concrete-pouring operations. Because of the fact that the reinforcing rod is disposed at a low elevation in the wall slab 10, excellent reinforcement against break-out of the head end of the anchor bolt 12 from the concrete slab 10 is afforded.

Heretofore, in marketing the lifting system which is disclosed in aforementioned U.S. Pat. No. 3,499,676, instructions are invariably given to contractors to the effect that the reinforcing rod which is employed in connection with proper use of the system must be bent upwardly and then passed over the anchor bolt. This being a somewhat tedious operation, many contractors ignore the instructions and, instead, they place the reinforcing bar at a higher elevation within the form so that without bending it, it lies over the anchor bolt. The result frequently is that there occurs a break-out not only of the anchor bolt but all of the bolt and the reinforcing rod.

Figure 2:
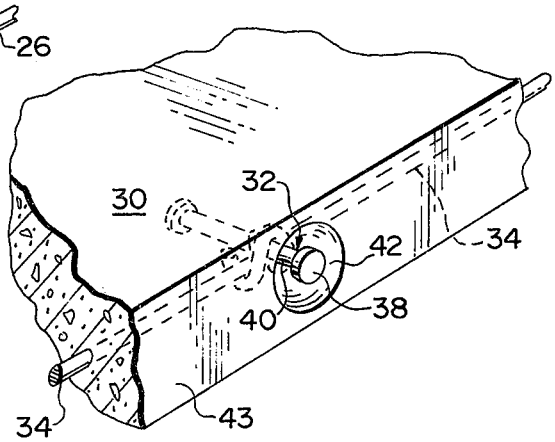
FIG. 2 is a fragmentary perspective edge view similar to FIG. 1 but illustrating the embedded portion of the present edge-lifting system operatively installed in the associated concrete slab.
Figure 3:
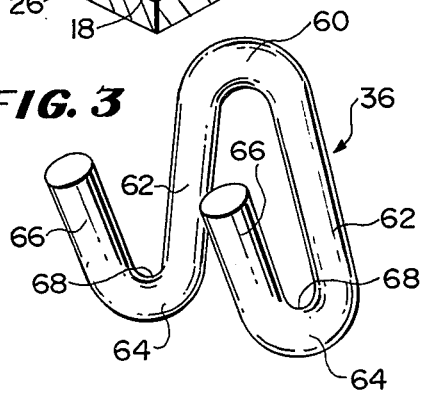
FIG. 3 is a perspective view of the suspension clip which is employed in and forms a part of the system constituting the present invention.

In FIGS. 2 to 6 of the drawings, there is disclosed a lifting system which preserves the use of an anchor bolt, such as the anchor bolt 12 of FIG. 1, and also the use of a reinforcing rod, such as the rod 26 of FIG. 1, with both the bolt and rod assuming their normal elevations within the associated concrete slab form and, consequently, within the hardened concrete slab, and in which, by means of a simple suspension or hanger clip such as is shown in detail in FIG. 3, the reinforcing rod is maintained at its relatively low level within the form without necessitating bending of the reinforcing rod from its normal linearly straight condition. Accordingly, the concrete wall slab 30, which is to be tilted to a vertical position, embodies the usual anchor bolt 32 at mid-level within the slab, and the linearly straight reinforcing rod 34, which is maintained at its normal low level within the slab, together with the aforementioned hanger clip by means of which the reinforcing rod 34 is suspended within the concrete slab form in a manner that will be made clear presently. Such hanger clip is identified in the drawings by the reference numeral 36. The head 38 of the anchor bolt 32 and a limited portion of the bolt shank 40 are exposed on the adjacent edge region 41 of the slab 30 and are disposed within a semi-spherical recess 42 and thus present outside lifting facilities similar to those which are provided in connection with the concrete wall slab 10 of FIG. 1.

Figure 4:
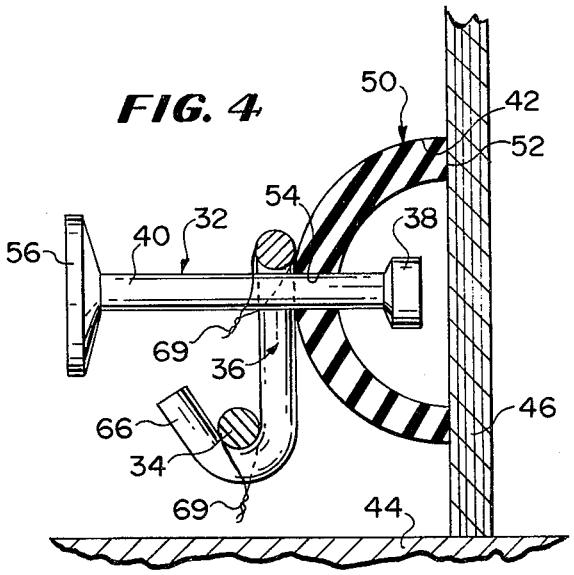
FIG. 4 is a fragmentary sectional view taken longitudinally through one side region of a concrete slab form and showing the improved hanger device operatively associated with an anchor rod and a reinforcing bar which are employed in connection with the invention preparatory to concrete-pouring operations.
Figure 5:
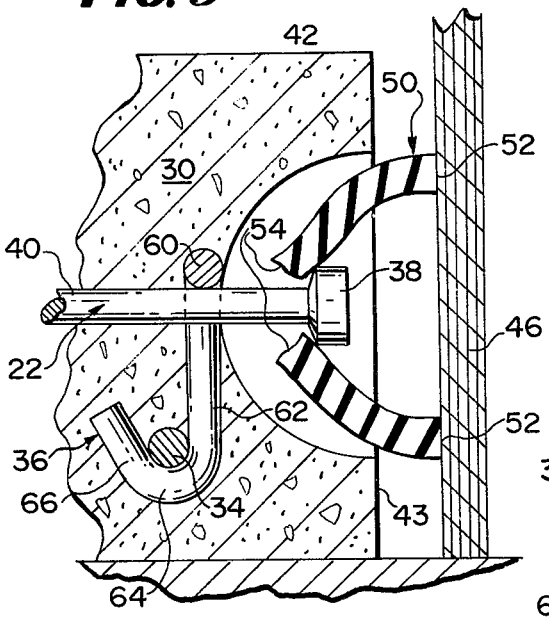
FIG. 5 is a sectional view similar to FIG. 4 but showing the structure after concrete-pouring operations have been completed and the form then removed.
Figure 6:
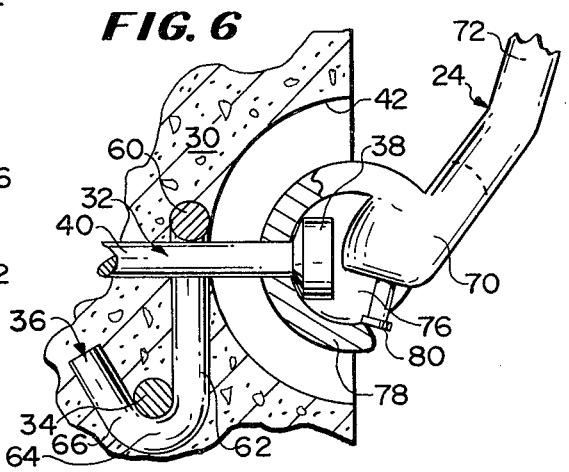
FIG. 6 is a sectional view similar to FIG. 5 but showing a lifting eye operatively applied to the anchor rod for slab-lifting purposes.

Referring now to FIGS. 4 and 5 wherein the form for the concrete wall slab 30 is fragmentarily shown, such form includes the usual form base 44 and form sides, only one of which is shown at 46. In order to support the anchor bolt 32 within the confines of the form in a transverse or horizontal position, and also to provide a pattern for the semi-spherical recess 42 in the slab 30, a flexible rubber or other elastomeric bolt-supporting and pattern ring 50 is employed or utilized. Such ring is of hollow, cup-shape, and semispherical configuration, has its circular rim cemented, glued, or otherwise suitably adhered to the inside face of the form side 46 as indicated at 52, and is provided with a centrally disposed opening or hole 54 at its apex region, such opening or hole being designed for reception therethrough of the shank portion 40 of the anchor bolt 32. With the pattern ring 50 fixedly secured to the form side as shown in FIG. 4, and with the anchor bolt 32 supported thereby so that its shank 40 extends horizontally and projects through the opening 54, its head 38 remains within the confines of the ring and its foot portion 56 is disposed outside the confines of the pattern ring, the hanger clip 36 is then applied to the shank 40 of the anchor bolt 32 and serves to support the reinforcing rod 34 at a relatively low level within the form and an appreciable distance below the anchor bolt so that this desired relationship will obtain after the concrete has been poured into the form and has become set to produce or form the wall slab 30.

Referring now to FIG. 3 of the drawings, the hanger clip 36 is in the form of a length of rod stock which is preferably formed of steel and is bent so as to provide a semi-circular or reverse bend 60 precisely at its mid-region, such bend affording a pair of spaced apart, downwardly extending, diverging legs 62. The lower ends of such legs are provided with reentrant bends 64 which afford a pair of spaced apart, upwardly and inwardly extending terminal legs 66 that are inclined at a slight angle to the legs 62. The two reentrant bends 64 define a pair of cradle-like hook portions 68 within which the longitudinally extending reinforcing rod 34 is adapted to be nested while the reverse bend 60 establishes a saddle by means of which the clip as a whole may be seated or supported on the shank 40 of the anchor bolt 32 as clearly shown in FIG. 4.

In erecting the form for the concrete wall slab 30, the pattern ring 50 is initially applied fixedly to the inside face of the form side 46, after which the form side is placed in proper position with respect to the form base 44. At the conclusion of this operation, the head 38 of the anchor bolt 32 is pushed through the opening or hole 54 in the apex region of the pattern ring 50 until the anchor bolt assumes the position in which it is shown in FIG. 4 with the head 38 substantially centered within the cup-shaped pattern ring 50. The elastomeric material of the pattern ring 50, although being flexible and, therefore, yieldable when the anchor bolt is applied thereto, is nevertheless possessed of sufficient firmness or rigidity that after the anchor bolt 32 is in place, said bolt will be held in the desired horizontal position.

It will be understood that at least one other pattern ring 50 will be applied to the form side 46 at the same horizontal level as the level of the illustrated pattern ring so that the reinforcing rod may be similarly suspended therefrom by means of another suspension or hanger clip 36, the rod thus running transversely or longitudinally, as the case may be, through the form in close proximity to the form side 46 so that in the completed concrete slab 30 it will extend through the latter at a relatively low region and extend parallel to the slab edge region 41 as shown in FIG. 2. In order to secure the saddle of the hanger clip 36 to the anchor bolt 32 and the reinforcing bar 34 to the cradle-like hook portions 68, tie wires 69 of soft metal stock may be passed around the abutting or juncture regions between the clip and both the anchor bolt 32 and reinforcing rod 34 and then tied in position as shown in FIG. 4. This tie wire serves to prevent the clip 32 or the reinforcing rod 34 from floating out of position when the concrete is subsequently poured into the slab form.

After all of the units of the lift system are properly in place, concrete-pouring operations are resorted to and the concrete is allowed to become hardened or set. Subsequent removal of the form sides will leave the finished slab 30 in condition for tilt-up operations.

Insofar as removal of the form side 46 is concerned, withdrawal of the form side from the edge region 41 of the slab 30 will serve to withdraw the flexible elastomeric pattern rings 50 from their associated recesses 42, the head portions 38 of the anchor bolts 32 slipping through the openings or holes 54 as shown in FIG. 5 as easily as they penetrated the pattern rings at the time of form installation. The edges of the openings or holes 54 are, of course, capable of flexing in either direction to allow the heads 38 to pass therethrough. During installation, the material of the pattern rings 50 will close upon the shanks 40 of the anchor bolts 32 and establish seals which will prevent the concrete from seeping into the confines of the pattern rings 50 when the wet concrete is poured.

An actual slab tilt-up operation is accomplished by utilizing a lifting eye 24 like that which was mentioned in connection with the slab structure 10 of FIG. 1. Such lifting eye is conventional and, in general, it is comprised of a casting having a body portion 70 from which there projects radially an eye portion proper 72 having an eyelet 73 therethrough (see FIG. 1). The eyelet 73 is designed for cooperation with a conventional lifting hook 74 which may be attached by means of a suitable cable or chain (not shown) to an overhead hoist. The body portion 70 is formed with a relatively deep slot-like recess 76 therein, such recess having spaced apart generally planar sides on which there are formed a pair of opposed spaced apart curved ribs 78 which may be directed endwise behind the bolt head 38 so that they straddle the shank 40 as shown in FIG. 4 when the eye portion proper 72 is brought to the desired inclination for lifting purposes. Since the anchor bolt head 38 lies inwardly of the edge region 41 of the concrete wall slab 30, the recess 42 affords a clearance space for entry of the hook-like ribs 78 behind the bolt head 38.

As a safety measure, a plunger 80 is slidable in the body portion 70 of the lifting eye and closes the entrance to the recess 76 after the head 38 of the anchor bolt 22 has moved into the recess.

The invention is not to be limited to the exact arrangement of parts shown in the accompanying drawings or described in this specification as various changes in the details of construction may be resorted to without departing from the spirit or scope of the invention. Therefore, only insofar as the invention is particularly pointed out in the accompanying claims is the same to be limited.

Having thus described the invention what I claim as new and desire to secure by letters patent is:

1. In a concrete slab form having a horizontal form base and an upstanding vertical form side, in combination, an anchor bolt supported from said form side in a horizontal position and at a level which corresponds approximately to the mid-level of the slab which is formed after wet concrete has been poured into the form, and having, in addition to a shank, an enlarged head spaced a comparatively small distance inwards of the form side, a semi-cylindrical, cup-shaped, recess-forming, pattern member having its circular rim secured to the form side, enveloping said head, and serving to support said bolt in its operative position as a preliminary to pouring of said wet concrete into the form, a horizontal linearly straight reinforcing rod disposed appreciably below the level of the anchor bolt and passing beneath said bolt so that the vertical planes of the bolt and rod intersect each other at a right angle, and a hanger clip extending between the shank of the anchor bolt and the reinforcing rod and serving loosely to suspend the latter from the anchor bolt and at a level relatively close to the form base preparatory to pouring of said wet concrete into the form in order to produce said slab, said reinforcing rod serving in the completed slab when the anchor bolt is raised for slab-lifting purposes to impart a reaction force to the anchor bolt through the medium of the hanger clip, said hanger clip being in the form of a length of stiff rod stock bent at its mid-point to provide a saddle portion which seats on the shank of the anchor bolt and has downwardly extending outwardly diverging, coplanar, side legs, the lower end of each leg being provided with a reentrant bend which defines an upwardly facing divergent cradle-like hook portion within which the reinforcing rod is seated, the two hook portions being spaced from each other and, in combination with each other, defining an upwardly facing rod-receiving cradle, said hanger clip constituting the sole support for the region of the reinforcing rod which passes beneath the anchor bolt.

2. In a concrete slab form, the combination set forth in claim 1 and including, additionally, a tie wire encompassing the shank of said anchor bolt and the saddle portion of the hanger clip, and an additional tie wire encompassing the reinforcing rod and at least one of said cradle-like hook portions, said tie wires serving to prevent floating of the suspension clip and reinforcing rod when the wet concrete is poured into the form.

* * * * *